US009741281B2

(12) United States Patent
Kim et al.

(10) Patent No.: US 9,741,281 B2
(45) Date of Patent: Aug. 22, 2017

(54) COUPLING COMPENSATOR FOR DISPLAY PANEL AND DISPLAY DEVICE INCLUDING THE SAME

(71) Applicant: Samsung Display Co., Ltd., Yongin, Gyeonggi-Do (KR)

(72) Inventors: Jong-Hee Kim, Yongin-si (KR); Jae-Keun Lim, Suwon-si (KR); Ji-Sun Kim, Seoul (KR); Young-Wan Seo, Suwon-si (KR); Chong-Chul Chai, Seoul (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 21 days.

(21) Appl. No.: 14/815,795

(22) Filed: Jul. 31, 2015

(65) Prior Publication Data

US 2016/0240128 A1 Aug. 18, 2016

(30) Foreign Application Priority Data

Feb. 12, 2015 (KR) ..... 10-2015-0021447

(51) Int. Cl.
*G09G 3/20* (2006.01)
*G09G 3/32* (2016.01)
(Continued)

(52) U.S. Cl.
CPC ..... *G09G 3/2007* (2013.01); *G09G 3/3233* (2013.01); *G09G 3/3291* (2013.01);
(Continued)

(58) Field of Classification Search
CPC ..... G09G 2310/08; G09G 2320/0626; G09G 3/3233; G09G 2330/021; G09G 2360/16
See application file for complete search history.

(56) References Cited

U.S. PATENT DOCUMENTS 5,473,338 A * 12/1995 Prince ..... G09G 3/3625 345/204
5,861,869 A * 1/1999 Scheffer ..... G09G 3/3625 345/691
(Continued)

FOREIGN PATENT DOCUMENTS

KR 10-2007-0057782 A 6/2007
KR 10-2011-0063021 A 6/2011
(Continued)

OTHER PUBLICATIONS

Extended European Search Report dated Aug. 10, 2016 for European Patent Application No. EP 16 155 453.0 which corresponds to subject U.S. Appl. No. 14/815,795.

*Primary Examiner* — Olga Merkoulova
(74) *Attorney, Agent, or Firm* — Knobbe Martens Olson & Bear LLP

(57) ABSTRACT

A coupling compensator for a display panel and a display device including the coupling compensator are disclosed. In one aspect, the coupling compensator includes a memory configured to receive grayscale data and store the grayscale data and a first data converter configured to convert the grayscale data to a plurality of grayscale data voltages including first and second grayscale data voltages. The compensator also includes a coupling voltage calculator configured to calculate a line coupling voltage generated on a data line based on the difference between the first grayscale data voltage corresponding to the grayscale data provided to a first group of the pixels in an (N−1)th row and the second grayscale data voltage corresponding to the grayscale data provided to a first group of the pixels in an Nth row, where the N is an integer equal to or greater than 2.

21 Claims, 6 Drawing Sheets

(51) Int. Cl.
*G09G 3/3233* (2016.01)
*G09G 3/3291* (2016.01)

(52) U.S. Cl.
CPC ..... *G09G 2310/027* (2013.01); *G09G 2310/0248* (2013.01); *G09G 2310/08* (2013.01); *G09G 2320/0209* (2013.01); *G09G 2320/0219* (2013.01); *G09G 2320/0285* (2013.01); *G09G 2320/0626* (2013.01); *G09G 2360/16* (2013.01)

(56) References Cited

U.S. PATENT DOCUMENTS

2007/0296669 A1* 12/2007 Jeon ..... G09G 3/2011 345/89
2008/0074362 A1 3/2008 Ogura
2008/0094334 A1* 4/2008 Baek ..... G09G 3/3677 345/89
2008/0238953 A1 10/2008 Ogura
2014/0184671 A1* 7/2014 Lee ..... G09G 3/006 345/697

FOREIGN PATENT DOCUMENTS

KR 10-2013-0058496 A 6/2013
KR 10-2014-0034611 A 3/2014

* cited by examiner

120

| GRAYSCALE DATA(G) | GRAYSCALE DATA VOLTAGE(Vd) |
|---|---|
| 0 | 3.50 |
| 1 | 3.49 |
| 2 | 3.48 |
| 3 | 3.47 |
| ⋮ | ⋮ |
| 252 | 1.03 |
| 253 | 1.02 |
| 254 | 1.01 |
| 255 | 1.00 |

FIG. 3

150

| COMPENSATING DATA VOLTAGE(Vdc) | COMPENSATING GRAYSCALE DATA(Gc) |
|---|---|
| 1.00 ~ 1.01 | 255 |
| 1.01 ~ 1.02 | 254 |
| 1.02 ~ 1.03 | 253 |
| 1.03 ~ 1.04 | 252 |
| ⋮ | ⋮ |
| 3.47 ~ 3.48 | 3 |
| 3.48 ~ 3.49 | 2 |
| 3.49 ~ 3.50 | 1 |
| 3.50 ~ 3.51 | 0 |

FIG. 5

| ROW | GRAYSCALE DATA(G) | GRAYSCALE DATA VOLTAGE(Vd) | COUPLING RATIO(Rc) | AMOUNT OF COUPLING(C) | LINE COUPLING VOLTAGE(Vc) | COMPENSATING DATA VOLTAGE(Vdc) | COMPENSATING GRAYSCALE DATA(Gc) |
|---|---|---|---|---|---|---|---|
| 1 | G1 | Vd1 | | C1 | | Vdc1 | Gc1 |
| 2 | G2 | Vd2 | | C2 | | Vdc2 | Gc2 |
| 3 | G3 | Vd3 | | C3 | | Vdc3 | Gc3 |
| 4 | G4 | Vd4 | Rc | C4 | Vc | Vdc4 | Gc4 |
| ⋮ | ⋮ | ⋮ | | ⋮ | | ⋮ | ⋮ |
| n-1 | G(N-1) | Vd(N-1) | | C(N-1) | | Vdc(N-1) | Gc(N-1) |
| n | G(N) | Vd(N) | | C(N) | | Vdc(N) | Gc(N) |
| ⋮ | ⋮ | ⋮ | | ⋮ | | ⋮ | ⋮ |

COUPLING COMPENSATOR FOR DISPLAY PANEL AND DISPLAY DEVICE INCLUDING THE SAME

CROSS-REFERENCE TO RELATED APPLICATION(S)

This application claims priority under 35 USC §119 to Korean Patent Application No. 10-2015-0021447, filed on Feb. 12, 2015 in the Korean Intellectual Property Office (KIPO), the contents of which are incorporated herein in its entirety by reference.

BACKGROUND

Field

The described technology generally relates to a coupling compensator for a display panel and display device including the same.

Description of the Related Technology

Flat panel displays (FPDs) are widely used because they are relatively lightweight and thin compared to cathode-ray tube (CRT) displays. Examples of flat panel technologies include liquid crystal displays (LCDs), field emission displays (FEDs), plasma display panels (PDPs), and organic light-emitting diode (OLED) displays. OLED technology has been considered as a next-generation display because it has favorable characteristics such as wide viewing angles, rapid response speeds, thin profiles, low power consumption, etc.

Generally, an OLED display includes a plurality of scan lines, a plurality of data lines, a plurality of pixel circuits connected to the scan lines and data lines, and a matrix of OLEDs included in the pixels circuits. As a resolution of the OLED display increases, the number of wires increases and difficulty of integrating the components also increases.

SUMMARY OF CERTAIN INVENTIVE ASPECTS

One inventive aspect relates to a coupling compensator for a display device that can compensate a coupling voltage of a data line and a display device including the same.

Another aspect is a coupling compensator for a display panel that includes a memory configured to receive grayscale data provided to pixels in the display panel an to memory the grayscale data, a first data converter configured to convert the grayscale data to a grayscale data voltage, a coupling voltage calculator configured to calculate a line coupling voltage that occurs on a data line based on a difference between the grayscale data voltage corresponding to the grayscale data provided to the pixel in an (N−1)th row and the grayscale data voltage corresponding to the grayscale data provided to the pixel in an Nth row, where the N is an integer greater than or equal to 2, a compensating data generator configured to generate a compensating data voltage that compensates the line coupling voltage, and a second data converter configured to convert the compensating data voltage to a compensating grayscale data.

In example embodiments, the coupling voltage calculator calculates an amount of a coupling that occurs on the pixel coupled to the data line in the Nth row by multiplying a predetermined coupling ratio by the difference between the grayscale data voltage corresponding to the grayscale data provided to the pixel in the Nth row and the grayscale data voltage corresponding to the grayscale data provided to the pixel in the (N−1)th row. The coupling voltage calculator can output a mean value of the amounts of the coupling that occurs on the pixels coupled to the data line as the line coupling voltage of the data line.

In example embodiments, the memory is implemented as a line memory that stores the grayscale data provided to the pixels in at least two rows.

In example embodiments, the coupling voltage calculator calculates the line coupling voltage based on the grayscale data voltage corresponding to the grayscale data stored in the line memory, and the compensating data generator outputs the compensating data voltage of a next frame by adding the line coupling voltage to the grayscale data voltage corresponding to the grayscale data.

In example embodiments, the memory is implemented as a frame memory that stores the grayscale data provided to the pixels per a frame.

In example embodiments, the coupling voltage compensator calculates the line coupling voltage based on the grayscale data voltage corresponding to the grayscale data stored in the frame memory, and the compensating data generator outputs the compensating data voltage of a next frame by adding the line coupling voltage to the grayscale data voltage corresponding to the grayscale data.

In example embodiments, the first data converter is implemented as a look-up table (LUT) that stores the grayscale data voltage corresponding to the grayscale data.

In example embodiments, the second data converter is implemented as a look-up table (LUT) that stores the compensating grayscale data corresponding to the compensating data voltage.

Another aspect is a display device that includes a display panel including a plurality of data lines, a plurality of scan lines, and a plurality of pixels formed in an intersection region of the data lines and the scan lines, a coupling compensator configured to calculate a line coupling voltage that occurs on each of the data lines based on a difference between the grayscale data provided to the pixel in an (N−1)th row and the grayscale data provided to the pixel in an Nth row, and generate the compensating grayscale data that compensates the line coupling voltage, where the N is an integer greater than or equal to 2, a data driver configured to convert the compensating grayscale data to a data signal and provide the data signal to the pixels through the data lines, a scan driver configured to provide a scan signal to the pixels through the scan lines, and a timing controller configured to control the coupling compensator, the data driver, and the scan driver.

In example embodiments, the coupling compensator includes a memory configured to receive the grayscale data provided to the pixels and to store the grayscale data, a first data converter configured to convert the grayscale data to a grayscale data voltage, a coupling voltage calculator configured to calculate the line coupling voltage that occurs on the data line based on a difference between the grayscale data voltage corresponding to the grayscale data provided to the pixel in the (N−1)th row and the grayscale data voltage corresponding to the grayscale data provided to the pixel in the Nth row, a compensating data generator configured to generate a compensating data voltage that compensates the line coupling voltage, and a second data converter configured to convert the compensating data voltage to a compensating grayscale data.

In example embodiments, the coupling voltage calculator calculates an amount of a coupling that occurs on the pixel coupled to the data line in the Nth row by multiplying a predetermined coupling ratio by a difference between the grayscale data voltage corresponding to the grayscale data provided to the pixel in the Nth row and the grayscale data voltage corresponding to the grayscale data provided to the pixel in the (N−1)th row, and outputs a mean value of the amounts of the coupling that occurs on the pixels coupled to the data line as the line coupling voltage of the data line.

In example embodiments, the memory is implemented as a line memory that stores the grayscale data provided to the pixels in at least two rows.

In example embodiments, the coupling voltage calculator calculates the line coupling voltage based on the grayscale data voltage corresponding to the grayscale data stored in the line memory, and the compensating data generator outputs the compensating data voltage of a next frame by adding the line coupling voltage to the grayscale data voltage corresponding to the grayscale data.

In example embodiments, the memory is implemented as a frame memory that stores the grayscale data provided to the pixels per a frame.

In example embodiments, the coupling voltage calculator calculates the line coupling voltage based on the grayscale data voltage corresponding to the grayscale data stored in the frame memory, and the compensating data generator outputs the compensating data voltage of a next frame by adding the line coupling voltage to the grayscale data voltage corresponding to the grayscale data.

In example embodiments, the first data converter is implemented as a look-up table (LUT) that stores the grayscale data voltage corresponding to the grayscale data.

In example embodiments, the second data converter is implemented as a look-up table (LUT) that stores the compensating grayscale data corresponding to the compensating data voltage.

In example embodiments, the coupling compensator is formed in the timing controller.

In example embodiments, the coupling compensator is coupled to the timing controller.

Another aspect is a coupling compensator for a display panel including a plurality of pixels, the coupling compensator comprising: a memory configured to receive grayscale data and store the grayscale data; a first data converter configured to convert the grayscale data to a plurality of grayscale data voltages including first and second grayscale data voltages; a coupling voltage calculator configured to calculate a line coupling voltage generated on a data line based on the difference between the first grayscale data voltage corresponding to the grayscale data provided to a first group of the pixels in an (N−1)th row and the second grayscale data voltage corresponding to the grayscale data provided to a first group of the pixels in an Nth row, where the N is an integer equal to or greater than 2; a compensating data generator configured to generate a compensating data voltage configured to compensate the line coupling voltage; and a second data converter configured to convert the compensating data voltage to a compensating grayscale data.

In the above coupling compensator, the coupling voltage calculator is further configured to multiply a predetermined coupling ratio by the difference between the first and second grayscale data voltages so as to calculate an amount of coupling for each pixel and output a mean value of the amounts of the coupling as the line coupling voltage of the data line.

In the above coupling compensator, the memory includes a line memory configured to store the grayscale data to be provided to a third group of the pixels of at least two rows.

In the above coupling compensator, the coupling voltage calculator is further configured to calculate the line coupling voltage based on the grayscale data voltage corresponding to the grayscale data stored in the line memory, wherein the compensating data generator is further configured to add the line coupling voltage to the grayscale data voltage corresponding to the grayscale data and output the added value as the compensating data voltage of a next frame.

In the above coupling compensator, the memory includes a frame memory configured to store the grayscale data to be provided to all the pixels per frame of the display panel.

In the above coupling compensator, the coupling voltage calculator is further configured to calculate the line coupling voltage based on the grayscale data voltage corresponding to the grayscale data stored in the frame memory, wherein the compensating data generator is further configured to add the line coupling voltage to the grayscale data voltage corresponding to the grayscale data stored in the frame memory and output the added value as the compensating data voltage.

In the above coupling compensator, the first data converter includes a look-up table (LUT) configured to store the grayscale data voltage corresponding to the grayscale data.

In the above coupling compensator, the second data converter includes a look-up table (LUT) configured to store the compensating grayscale data corresponding to the compensating data voltage.

Another aspect is a display device comprising: a display panel including a plurality of data lines, a plurality of scan lines, and a plurality of pixels formed in intersection regions of the data lines and the scan lines; a coupling compensator configured to i) calculate a line coupling voltage on each of the data lines based on the difference between first grayscale data provided to a first group of the pixels in an (N−1)th row and second grayscale data provided to a second group of the pixels in an Nth row and ii) generate the compensating grayscale data configured to compensate the line coupling voltage, where the N is an integer equal to or greater than 2; a data driver configured to convert the compensating grayscale data to a data signal and provide the data signal to all the pixels via the data lines; a scan driver configured to provide a scan signal to all the pixels via the scan lines; and a timing controller configured to control the coupling compensator, the data driver, and the scan driver.

In the above display device, the coupling compensator includes: a memory configured to receive the grayscale data and store the grayscale data; a first data converter configured to convert the grayscale data to a plurality of grayscale data voltages including first and second grayscale data voltages respectively corresponding to the first and second grayscale data; a coupling voltage calculator configured to calculate the line coupling voltage based on a difference between first grayscale data voltage and the second grayscale data voltage; a compensating data generator configured to generate a compensating data voltage corresponding to the compensating grayscale data so as to compensate the line coupling voltage; and a second data converter configured to convert the compensating data voltage to a compensating grayscale data.

In the above display device, the coupling voltage calculator is further configured to multiply a predetermined coupling ratio by a difference between the first and second grayscale data voltages so as to calculate an amount of coupling for each pixel and output a mean value of the amounts of the coupling as the line coupling voltage of the data line.

In the above display device, the memory includes a line memory configured to store the grayscale data to be provided to a third group of the pixels of at least two rows.

In the above display device, the coupling voltage calculator is further configured to calculate the line coupling voltage based on the grayscale data voltage corresponding to the grayscale data stored in the line memory, wherein the compensating data generator is further configured to add the line coupling voltage to the grayscale data voltage corresponding to the grayscale data and output the added value as the compensating data voltage of a next frame.

In the above display device, the memory includes a frame memory configured to store the grayscale data to be provided to all the pixels per frame of the display panel.

In the above display device, the coupling voltage calculator is further configured to calculate the line coupling voltage based on the grayscale data voltage corresponding to the grayscale data stored in the frame memory, wherein the compensating data generator is further configured to add the line coupling voltage to the grayscale date voltage corresponding to the grayscale data stored in the frame memory and output the added value as the compensating data voltage.

In the above display device, the first data converter includes a look-up table (LUT) configured to store the grayscale data voltage corresponding to the grayscale data.

In the above display device, the second data converter includes a look-up table (LUT) configured to store the compensating grayscale data corresponding to the compensating data voltage.

In the above display device, the timing controller includes the coupling compensator.

In the above display device, the coupling compensator is electrically connected to the timing controller.

Another aspect is a display device comprising: a display panel including a plurality of data lines, a plurality of scan lines, and a plurality of pixels formed in intersection regions of the data lines and the scan lines; and a coupling compensator configured to calculate a line coupling voltage for each of the data lines corresponding to an amount of coupling generated via a parasitic capacitor formed between each pixel and the corresponding data line. The coupling compensator includes: a first data converter configured to receive gray scale data corresponding to each pixel and convert the gray scale data into a grayscale data voltage; a coupling voltage calculator configured to receive the grayscale data voltage and calculate the line coupling voltage based on the grayscale data voltage; a compensation data generator configured to receive the line coupling voltage from the coupling voltage calculator and the grayscale data voltage from the first data converter, and generate a compensating data voltage based on the line coupling voltage and the grayscale data voltage; and a second data converter configured to receive the compensating data voltage and convert the compensating data voltage to compensating grayscale data. The display device also includes: a data driver configured to convert the compensating grayscale data to a data signal and provide the data signal to the pixels via the data lines; a scan driver configured to provide a scan signal to the pixels via the scan lines; and a timing controller configured to control the coupling compensator, the data driver, and the scan driver.

According to at least one of the disclosed embodiments, a coupling compensator of a display panel calculates a coupling voltage occurs on each of data lines based on a difference between grayscale data adjusted to adjacent pixel lows and compensates the coupling voltage. The coupling compensator can prevent a change of brightness of the display device by compensating the coupling voltage. Thus, a display quality of the display device including the coupling compensator can improve.

BRIEF DESCRIPTION OF THE DRAWINGS

FIG. 3 is a diagram illustrating an example of a second data converter included in the coupling compensator of the display panel of FIG. 1.

FIG. 5 is a diagram for describing an operation of the coupling compensator of the display panel of FIG. 1.

DETAILED DESCRIPTION OF CERTAIN INVENTIVE EMBODIMENTS

As the number of wires and the difficulty of integration increases, the probability of parasitic coupling between (coupling) wires or between a wire and an element occurring also increases which can cause a fluctuation of brightness in OLEDs.

Hereinafter, the described technology will be explained in detail with reference to the accompanying drawings. In this disclosure, the term "substantially" includes the meanings of completely, almost completely or to any significant degree under some applications and in accordance with those skilled in the art. Moreover, "formed on" can also mean "formed over." The term "connected" can include an electrical connection.

Figures 1, 2:
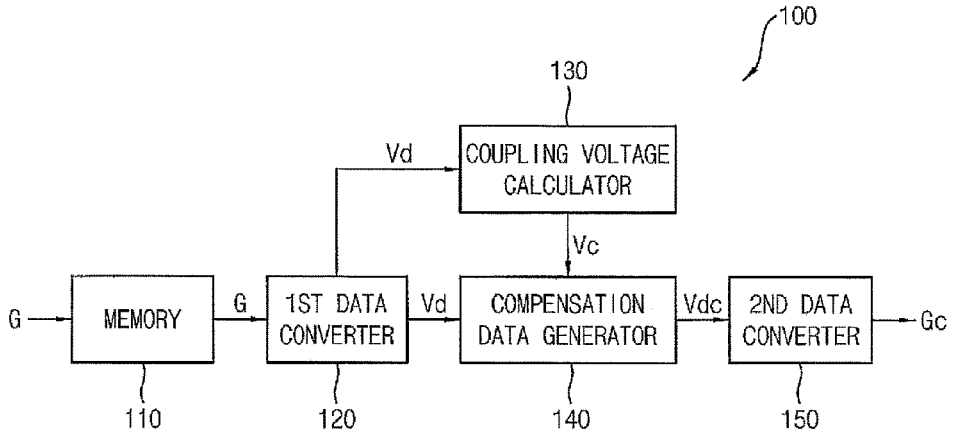
FIG. 1 is a block diagram illustrating a coupling compensator of a display panel according to example embodiments.
FIG. 2 is a diagram illustrating an example of a first data converter included in the coupling compensator of the display panel of FIG. 1.

FIG. 1 is a block diagram illustrating a coupling compensator of a display panel according to example embodiments. FIG. 2 is a diagram illustrating an example of a first data converter included in the coupling compensator of the display panel of FIG. 1. Depending on embodiments, certain elements may be removed from or additional elements may be added to the coupling compensator 100 illustrated in FIG. 1. Furthermore, two or more elements may be combined into a single element, or a single element may be realized as multiple elements. This applies to the remaining apparatus embodiments. FIG. 3 is a diagram illustrating an example of a second data converter included in the coupling compensator of the display panel of FIG. 1.

Referring to FIGS. 1 through 3, the coupling compensator 100 includes a memory 110, a first data converter, a coupling voltage calculator 130, a compensating data generator 140, and a second data converter 150. The coupling compensator 100 of FIG. 1 can calculate a line coupling voltage Vc that occurs on each of data lines based on a difference between grayscale data G applied to pixels in an adjacent two rows and compensate the line coupling voltage Vc.

For example, the memory 110 receives grayscale data G provided to the pixels in the display panel, and stores the grayscale data G. The memory 110 can receive the grayscale data G from an external device or through a timing controller 250 (see FIG. 6). In some example embodiments, the memory 110 is implemented as a line memory that stores the grayscale data G provided to the pixels in at least two rows. For example, the line memory stores the grayscale data G provided to the pixel in an (N−1)th row and the grayscale data G provided to the pixels in an Nth row, where the N is an integer greater than or equal to 2. In some example embodiments, the memory 110 is implemented as a frame memory that stores the grayscale data G provided to the pixels per a frame. For example, the frame memory stores grayscale data G provided to the pixels in a Kth frame, where the K is an integer greater than or equal to 1. The grayscale data G stored in the memory 110 can be provided to the first data converter 120.

The first data converter 120 can convert the grayscale data G to the grayscale data voltage Vd. The first data converter 120 can receive the grayscale data G provided to the pixels in the display penal from the memory 110. Generally, the grayscale data input as a digital data can be converted to a data voltage that is analog data in a data driver 230 (see FIG. 6). The data voltage that is the analog data can be provided to the pixels of the display panel. The first data converter 120 can convert the grayscale data G to the grayscale data voltage Vd corresponding to the data voltage provided to the pixels. Here, the grayscale data voltage Vd can be the digital data corresponding to the data voltage provided to the pixels. The first data converter 120 can be implemented as a look-up table (LUT) that stores the grayscale data voltage Vd corresponding to the grayscale data G. For example, the first data converter 120 stores grayscale data voltage Vd corresponding to 0 through 255 grayscale data. It should be understood that the look-up table can be implemented by any storage device that can store the grayscale data voltage Vd corresponding to the grayscale data G of the input data.

The coupling voltage calculator 130 can calculate the line coupling voltage Vc that occurs on the data line based on a difference between the grayscale data voltage Vd corresponding to the grayscale data G provided to the a first pixel in the (N−1)th row and the grayscale data voltage Vd corresponding to the grayscale data G provided to a second pixel in the Nth row. The difference is calculated for all of the rows where N is an integer greater than or equal to 2 and at most the maximum number of rows. Thus, the value of N is incremented and the differences between adjacent rows of the data line are added. A plurality of scan lines and a plurality of data lines can be arranged on the display panel. The pixels can be formed in intersection regions of the scan lines and the data lines. Here, a parasitic capacitor can be formed between the data line and the pixel. The grayscale data voltage Vd provided to the pixel can be changed by a coupling phenomenon that occurs by the parasitic capacitor. Amounts of the coupling can be changed based on the grayscale data voltage Vd provided to the pixels through the data line. The coupling voltage calculator 140 can calculate the amount of the coupling that occurs by the parasitic capacitor formed between the data line and the pixel based on the grayscale data voltage Vd provided to the adjacent pixels. For example, in order to account for the parasitic capacitor connected between the data line and the corresponding pixel on the Nth row, the coupling voltage calculator 130 calculates the amount of the coupling that occurs on the pixel coupled to the data line in the Nth row by multiplying a predetermined coupling ratio by the difference between the grayscale data voltage Vd corresponding to the grayscale data G provided to the pixel in the (N−1)th row and the grayscale data voltage Vd corresponding to the grayscale data G provided to the pixel in the Nth row, and outputs a mean value of the amounts of coupling that occurs on the pixels coupled to the data line as the line coupling voltage Vc of the data line. The coupling voltage calculator 130 can receive the grayscale data voltage Vd corresponding to the grayscale data G provided to the pixel in the Nth row of the data line and the grayscale data voltage Vd corresponding to the grayscale data G provided to the pixel in the (N−1)th row of the data line. The coupling voltage calculator 130 can calculate an amount of change of the grayscale data voltage Vd provided to the pixel in the Nth row by multiplying the predetermined coupling ratio by the difference between the grayscale data voltage Vd corresponding to the grayscale data G provided to the pixel coupled to the data line in the Nth row and the grayscale data voltage Vd corresponding to the grayscale data G provided to the pixel coupled to the data line in the (N−1)th row. The amount of the coupling of the pixel in the Nth row may be calculated in the coupling voltage calculator by Equation 1.

$$C[N]=Rc\times(Vd[N]-Vd[N-1]) \quad \text{[Equation 1]}$$

Here, C[N] is an amount of coupling of the pixel in the Nth row, Vd is the grayscale data voltage provided to the pixel in the Nth row, Vd[N−1] is the grayscale data voltage provided to the pixel in the [N−1]th, and the Rc is a coupling ratio of the pixels coupled to the Mth data line. The line coupling voltage of the Mth data line may be an average value of the amount of the coupling of the pixels coupled to the Mth data line as Equation 2. The capacity of the memory and the power consumption may decrease using the average value.

$$Vc=\text{Avg}\cdot C[N] \quad \text{[Equation 2]}$$

Here, the predetermined coupling ratio can be a ratio of i) the difference between the grayscale data voltage Vd corresponding to the grayscale data G provided to the pixel in the Nth row and the grayscale data voltage Vd corresponding to the grayscale data G provided to the pixel in the (N−1)th row to ii) the amount of the coupling that occurs on the pixel in the Nth row. The coupling ratio of the pixel in the Nth may be determined in a manufacturing process of the display device by an Equation 3.

$$Rc[N]=\frac{\Delta Vd[N]}{Vd[N]-Vd[N-1]} \quad \text{[Equation 3]}$$

Here, Rc[N] is a coupling ratio of the pixel in the Nth row, Vd[N] is a grayscale data voltage provided to the pixel in the Nth row, Vd[N−1] is a grayscale data voltage provided to the pixel in the [N−1]th row, and Δ Vd[N] is a difference of the grayscale data voltage provided to the pixel in the Nth row from the data driver and the grayscale data voltage output from the pixel in the Nth row. For example, when the difference between the grayscale data voltage Vd corresponding to the grayscale data G provided to the pixel in the Nth row and the grayscale data voltage Vd corresponding to the grayscale data G provided to the pixel in the (N−1)th row is about 0.8V and the grayscale data voltage Vd provided to the pixel in the Nth row is changed by about 0.4V, the coupling ratio can be 0.5. The coupling ratio of Mth data line may be an average value of the coupling ratios of the pixels coupled to the Mth data line as Equation 4.

$$Rc=\text{Avg}\cdot Rc[N] \quad \text{[Equation 4]}$$

The coupling ratio can be changed based on a material and size of the data line and the pixel. Therefore, the coupling ratio can be determined through an experiment or a measurement according to a property of the display panel. The coupling voltage calculator 130 can calculate amounts of the coupling that occurs on the pixels based on the difference between the grayscale data voltages Vd provided to the adjacent pixels coupled to the data line, and output the mean value of the amounts of the coupling as the line coupling voltage Vc. For example, when the number of pixels coupled to one data line is 800, the number of amounts of the coupling that is calculated in the coupling voltage calculator 130 is 799. Here, the amounts of the coupling may be calculated by multiplying the coupling ratio by the difference between the grayscale data voltages Vd provided to the adjacent pixels. The coupling voltage calculator 130 may output the average value of the amounts of the coupling as the line coupling voltage Vc. The coupling voltage calculator 130 can calculate the line coupling voltage Vc of the data lines. In this disclosure, the difference in grayscale data voltages between adjacent pixels in Nth and (N−1)th rows is not the line coupling voltage. Instead, the difference is summed up for all of the pixels that are connected to the data line and averaged to create one line coupling voltage Vc.

The compensating generator 140 can generate a compensating data voltage Vdc that compensates the line coupling voltage Vc of the data line. The compensating data generator 140 can generate the compensating data voltage Vdc by adding the line coupling voltage Vc to the grayscale data voltage Vd provided from the first data converter 120. In some example embodiments, the compensating data generator 140 generates compensating data voltage Vdc of a next frame by adding the line coupling voltage Vc to the grayscale data voltage Vd corresponding to the grayscale data of the next frame when the memory 110 is implemented as the line memory. For example, the grayscale data G provided to the pixel in the (N−1)th row of the Kth frame and the grayscale data G provided to the pixel in the Nth row of the Kth frame is stored in the line memory. The coupling voltage calculator 130 can calculate the line coupling voltage Vc based on the grayscale data voltage Vd corresponding to the grayscale data G provided to the pixel in the (N−1)th row of the Kth frame and the grayscale data voltage Vd corresponding to the grayscale data G provided to the pixel in the Nth row of the Kth frame while an image of the Kth frame is displayed on the display panel. The grayscale data G of a (K+1)th frame can be converted to the grayscale data voltage Vd in the first data converter 120 and can be provided to the compensating data generator 140. The compensating data generator 140 can output the compensating data voltage Vdc of the (K+1)th frame by adding the line coupling voltage Vc of the Kth frame to the grayscale data voltage Vd corresponding to the grayscale data G of the (K+1)th frame. In some example embodiments, the compensating data generator 140 generates the compensating data voltage Vdc by adding the line coupling voltage Vc to the grayscale data voltage Vd corresponding to the grayscale data G stored in the frame memory when the memory 110 is implemented as the frame memory. For example, the grayscale data G of the Kth frame is stored in the frame memory. The line coupling calculator 130 can calculate the line coupling voltage Vc based on the grayscale data voltage Vd corresponding to the grayscale data G provided to the pixel in the (N−1)th row stored in the frame memory and the grayscale data voltage Vd corresponding to the grayscale data G provided to the pixel in the Nth row stored in the frame memory. The compensating data generator 140 can output the compensating data voltage Vdc of the Kth frame by adding the line coupling voltage Vc to the grayscale data voltage Vd corresponding to the grayscale data G stored in the frame memory. The compensating data generator 140 can generate the compensating data voltages Vdc that compensate the grayscale data voltages Vd provided to each of the data lines based on the line coupling voltage Vc of each of the data lines.

The second data converter 150 can convert the compensating data voltage Vdc to the compensating grayscale data Gc. The second data converter 150 can receive the compensating data voltage Vdc from the compensating data generator 140. The compensating data voltage Vdc can be the digital data corresponding to the data voltage that is the analog data provided to the pixels. The second data converter 150 can be implemented as the look-up table that stores the compensating grayscale data Gc corresponding to the compensating data voltage Vdc. For example, the second data converter 150 stores the compensating grayscale data Gc corresponding to the compensating data voltage Vdc that is divided into 256 sections as described in FIG. 3. It should be understood that the look-up table can be implemented by a storage device that can store the compensating grayscale data Gc corresponding to the compensating data voltage Vdc. In some example embodiments, the compensating grayscale data Gc output from the second data converter 150 is provided to the data driver of the display device and is converted to the analog voltage in the data driver. In some example embodiments, the compensating grayscale data Gc output from the second data converter 150 is provided to the timing controller. The timing controller can perform an additional image process and provide the compensating grayscale data Gc to the data driver.

As described above, the coupling compensator of FIG. 1 can prevent a change of brightness of the display device occurred by the coupling phenomenon by calculating the line coupling voltage Vc that occurs on the data lines based on the difference between the grayscale data G provided to the adjacent pixel rows and compensating the line coupling voltage Vc. The amount of the coupling may be dependent to the grayscale data G provided to the pixel. The coupling compensator 100 may calculate the compensating grayscale data Gc based on the grayscale data G every frames. Thus, the coupling phenomenon according to the grayscale data G provided to the pixels may be compensated every frames.

Figure 4:
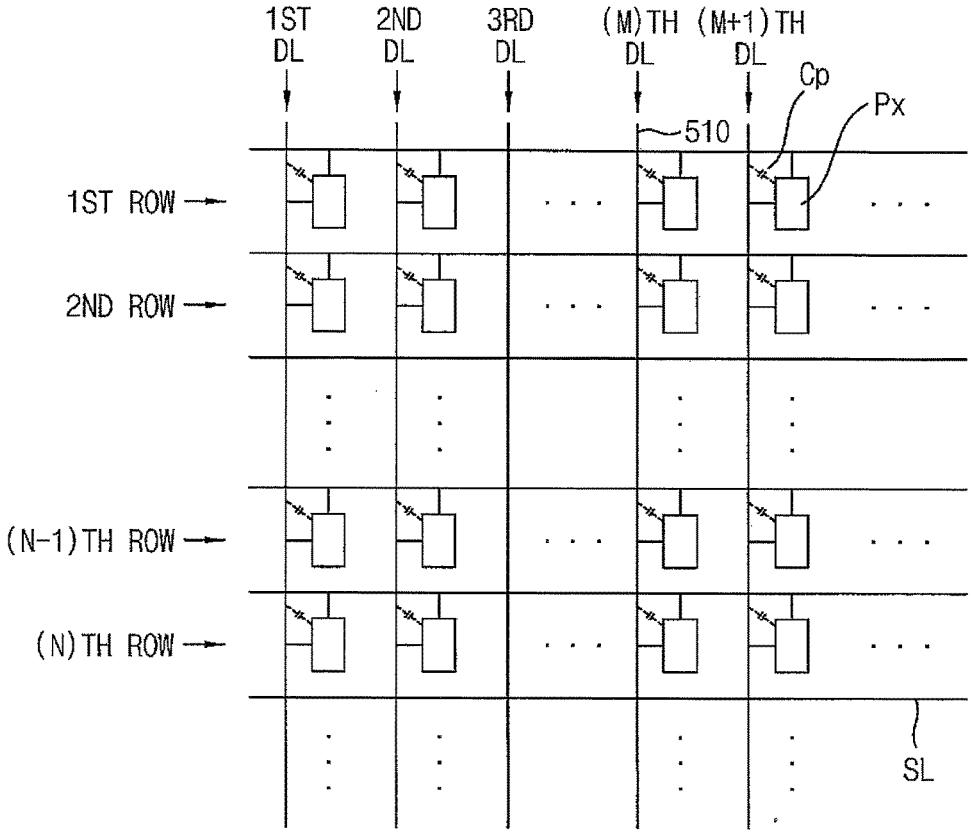
FIG. 4 is a diagram illustrating a display panel coupled to the coupling compensator of the display panel of FIG. 1.

FIG. 4 is a diagram illustrating a display panel coupled to the coupling compensator of the display panel of FIG. 1. FIG. 5 is a diagram for describing an operation of the coupling compensator of the display panel of FIG. 1.

Referring to FIG. 4, a plurality of data lines DL and a plurality of scan lines SL are arranged in a display panel. A plurality of pixels Px can be formed in intersection regions of data lines DL and scan lines SL. Here, a parasitic capacitor Cp can be formed between the data lines DL and the pixels Px. A coupling phenomenon can occur due to the parasitic capacitor Cp. Thus, a grayscale data voltage provided to the pixel Px can be changed by the coupling phenomenon. Amount of the coupling occurred by the parasitic capacitor Cp can be changed based on a grayscale data voltage Vd provided to the pixels Px through the data line DL.

Referring to FIG. 5, the coupling compensator of the display panel calculates line coupling voltages Vc of each of the data lines DL and generates a compensating data that compensate the line coupling voltages Vc of the data lines DL. For example, the coupling compensator calculates the line coupling voltage Vc of the Mth data line 510 and compensates the line coupling voltage Vc of the Mth data line 510. The memory can store the grayscale data G provided to the pixels coupled to the Mth data line 510. The first data converter can convert the grayscale data G to the grayscale data voltage Vd. Here, the grayscale data voltage Vd can be a digital data corresponding to the data voltage provided to the pixels Px. The coupling voltage calculator can calculate the line coupling voltage Vc that occurs on the Mth data line 510 based on the difference between the grayscale data voltage Vc provided to the adjacent pixels Px coupled to the Mth data line 510. For example, the coupling voltage calculator calculates the amount of the coupling C(N) that occurs on the pixel in the Nth row of the Mth data line 510 by multiplying the coupling ratio Rc by the difference between the grayscale data voltage Vd(N−1) of the (N−1)th row and the grayscale data voltage Vd(N) of the Nth row. The coupling voltage calculator can output the mean value of the amounts of the coupling C of the Mth data line 510 as the line coupling voltage Vc of the Mth data line 510. Here, the amount of the coupling C1 provided to the pixel in the first row can be zero. The compensating data generator can generate the compensating data voltage Vdc by adding the line coupling voltage Vc to the grayscale data voltage Vd. For example, the compensating data generator generates the compensating data voltage Vdc(N) of the pixel in the Nth row by adding the line coupling voltage Vc to the grayscale data voltage Vd(N) in the Nth row. In some example embodiments, the compensating data generator generates the compensating data voltage Vdc of the (K+1)th frame by adding the line coupling voltage Vc of the Kth frame to the grayscale data voltage Vd of the (K+1)th frame when the memory of the coupling compensator is implemented as a line memory. In some example embodiments, the compensating data generator generates the compensating data voltage Vdc of the Kth frame by adding the line coupling voltage of the Kth frame to the grayscale data voltage Vd of the Kth frame stored in the frame memory when the memory of the coupling compensator is implemented as a frame memory. The compensating data generator can generate the compensating data voltage Vdc that compensates the line coupling voltage Vc of each of the data lines DL. The second data converter can convert the compensating data voltage Vdc to the compensating grayscale data Gc.

Figure 6:
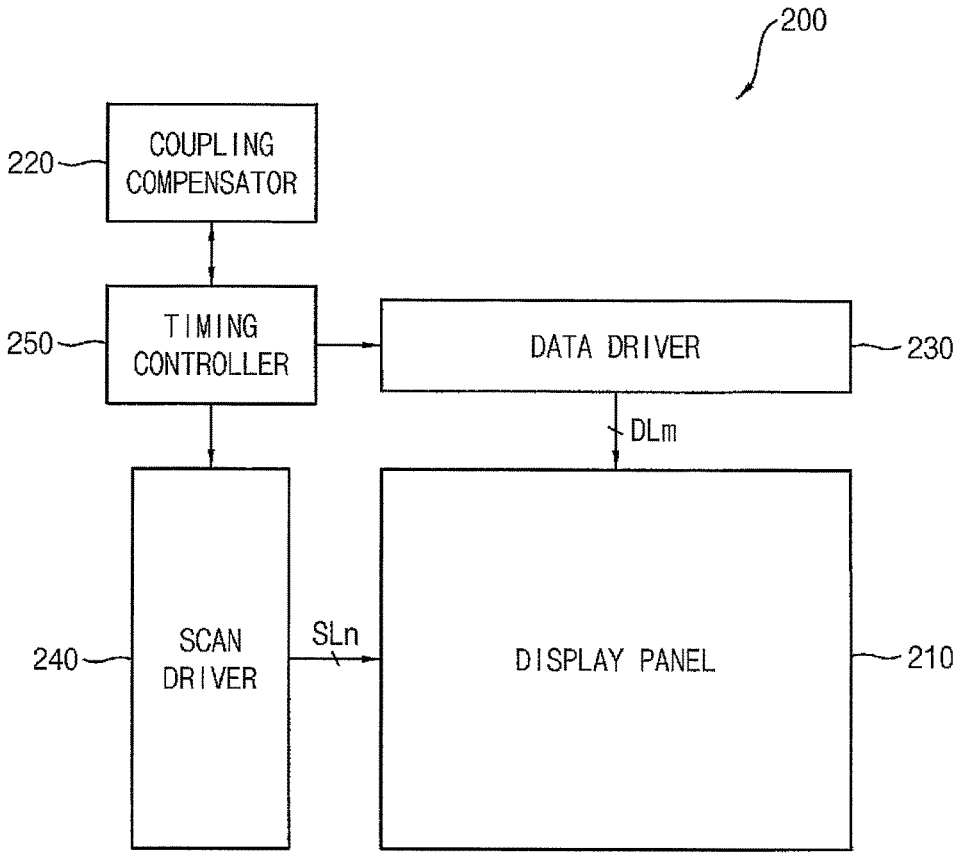
FIG. 6 is a block diagram illustrating a display device according to example embodiments.

FIG. 6 is a block diagram illustrating a display device according to example embodiments.

Referring to FIG. 6, the display device 200 includes a display panel 210, a coupling compensator 220, a data driver 230, a scan driver 240, and a timing controller 250.

The display panel 210 can include a plurality of pixels. A plurality of data lines DLm and a plurality of scan lines SLn can be arranged on the display panel 210. The pixels can be formed in intersection regions of the data lines DLm and the scan lines SLn. In some example embodiments, each of the pixels can include a pixel circuit, a driving transistor, and an organic light-emitting diode (OLED). In this case, the pixel circuit can control a current flowing through the OLED based on a data signal, where the data signal is provided via the data line in response to the scan signal, where the scan signal is provided via the scan line.

Here, a parasitic capacitor can be formed between the data lines DLm and pixels. A coupling phenomenon can occur due to the parasitic capacitor. The data signal, that is, the data voltage can be changed by the coupling phenomenon. Amount of the coupling can be changed based on the data voltage provided through the data lines DLm. The coupling compensator 220 can compensate the coupling phenomenon occurred by the parasitic capacitor formed between the data lines DLm and the pixels. In some example embodiments, the coupling compensator 220 is formed in the timing controller 250. In some example embodiments, the coupling compensator 220 is coupled to the timing controller 250.

For simplicity, repetition of the description of the coupling compensator and other elements explained above is omitted. As described above, the display device 200 of FIG. 6 prevents a change of the brightness of the display device 200 occurred due to the coupling phenomenon by including the coupling compensator that calculates the line coupling voltage that occurs on each of the data lines based on the difference between the grayscale data provided to adjacent pixel rows through the data lines DLm and compensates the line coupling voltage of data lines DLm.

Figure 7:
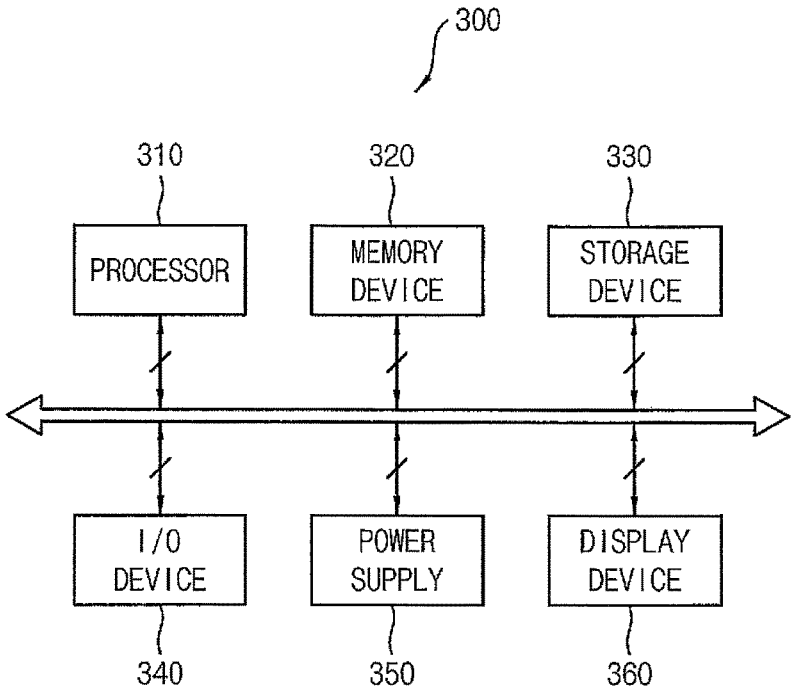
FIG. 7 is a block diagram illustrating an electronic device including the display device of FIG. 6.
Figure 8:
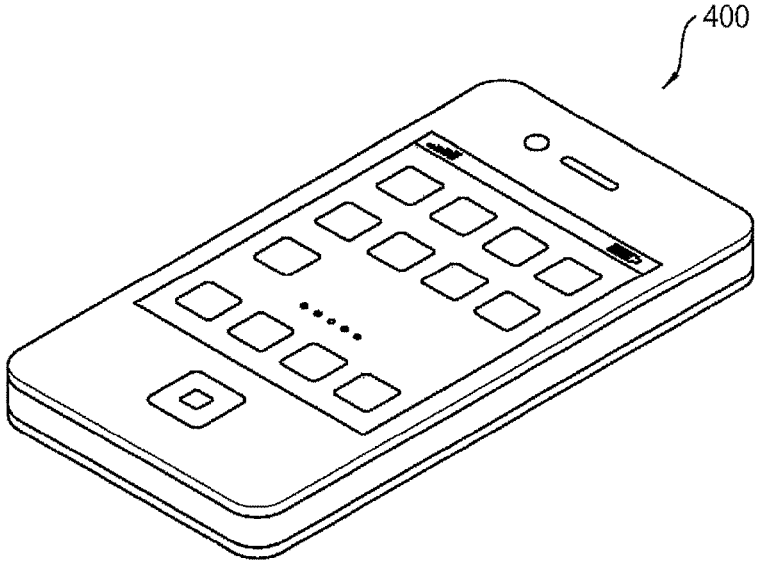
FIG. 8 is a diagram illustrating an example embodiment in which the electronic device of FIG. 7 is implemented as a smartphone.

FIG. 7 is a block diagram illustrating an electronic device including the display device of FIG. 6. FIG. 8 is a diagram illustrating an example embodiment in which the electronic device of FIG. 7 is implemented as a smartphone.

Referring to FIGS. 7 and 8, an electronic device 300 includes a processor 310, a memory device 320, a storage device 330, an input/output (I/O) device 340, a power device 350, and a display device 360. Here, the display device 360 can correspond to the display device 200 of FIG. 6. In addition the electronic device 300 can further include a plurality of ports for communicating a video card, a sound card, a memory card, a universal serial bus (USB) device, other electronic device, etc. Although it is illustrate in FIG. 8 that the electronic device 300 is implemented as a smartphone 400, the kind of the electronic device 300 is not limited thereto.

The processor 310 can perform various computing functions. The processor 310 can be a microprocessor, a central processing unit (CPU), etc. The processor 310 can be coupled to other components via an address bus, a control bus, a data bus, etc. Further, the processor 310 can be coupled to an extended bus such as peripheral component interconnect (PCI) bus. The memory device 320 can store data for operations of the electronic device 300. For example, the memory device 320 includes at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device such as a dynamic random access memory (DRAM) device, a static random access memory (SRAM) device, a mobile DRAM device, etc. The storage device 330 can be a solid state drive (SSD) device, a hard disk drive (HDD) device, a CD-ROM device, etc.

The I/O device 340 can be an input device such as a keyboard, a keypad, a touchpad, a touch-screen, a mouse, etc., and an output device such as a printer, a speaker, etc. In some example embodiments, the display device 360 is included in the I/O device 340. The power device 350 can provide power for operating the electronic device 300. The display device 360 can communicate with other components via the busses or other communication links. As described above, the display device 360 can include the display panel, the coupling compensator, the data driver, the scan drive, and the timing controller, and repetition of description is omitted for simplicity.

As described above, the electronic device 300 of FIG. 7 prevents the change of brightness that occurs by the coupling phenomenon by including the display device that calculates the amount of coupling based on the difference of the grayscale data applied to the adjacent pixels and compensates the amount of the coupling of the pixels.

The described technology can be applied to a display device and an electronic device having the display device. For example, the described technology can be applied to computer monitors, laptop computers, digital cameras, cellular phones, smartphones, smart pads, televisions, personal digital assistants (PDAs), portable multimedia players (PMPs), MP3 players, navigation systems, game consoles, video phones, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the inventive technology. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A data voltage compensator for a display panel including a plurality of pixels, the coupling compensator comprising:

a memory configured to receive a plurality of grayscale data that are digital signals and store the grayscale data;

a first data converter configured to i) convert the grayscale data respectively to a plurality of grayscale data voltages that are analog signals including first and second grayscale data voltages based on a first look-up table (LUT) including a relationship between the grayscale data and the plurality of grayscale data voltages and ii) output the plurality of grayscale data voltages;

a coupling voltage calculator configured to receive the grayscale data voltages and calculate a line coupling voltage, which is defined as a voltage on a parasitic capacitor formed between a selected one of the pixels and a corresponding data line, based on the difference between the first grayscale data voltage corresponding to the grayscale data provided to a first pixel of the pixels in an (N−1)th row and the second grayscale data voltage corresponding to the grayscale data provided to a second pixel of the pixels in an Nth row, where the N is an integer equal to or greater than 2;

a compensating data generator configured to generate a plurality of compensating data voltages, which include a sum of the line coupling voltage and the corresponding one of the plurality of grayscale data voltages, configured to compensate the line coupling voltage; and a second data converter configured to i) convert the plurality of compensating data voltages respectively to a plurality of compensating grayscale data based on a second LUT including a relationship between the plurality of compensating data voltage and the compensating grayscale data and ii) output the compensating grayscale data to a data driver of the display panel.

2. The data voltage compensator of claim 1, wherein the coupling voltage calculator is further configured to multiply a predetermined coupling ratio by the difference between the first and second grayscale data voltages, calculate an amount of coupling for each pixel based on the result, and output a mean value of the amounts of the coupling for the plurality of pixels as the line coupling voltage of the data line, and wherein the predetermined coupling ratio includes a ratio of i) the difference between the grayscale data voltage corresponding to the grayscale data provided to the first pixel and the grayscale data voltage corresponding to the grayscale data provided to the second pixel to ii) an amount of the coupling that occurs on the first pixel.

3. The data voltage compensator of claim 1, wherein the memory includes a line memory configured to store the grayscale data to be provided to the pixels of at least two rows.

4. The data voltage compensator of claim 3, wherein the coupling voltage calculator is configured to calculate the line coupling voltage based on the plurality of grayscale data voltages respectively corresponding to the grayscale data stored in the line memory.

5. The data voltage compensator of claim 1, wherein the memory includes a frame memory configured to store the grayscale data to be provided to all the pixels per frame of the display panel.

6. The data voltage compensator of claim 5, wherein the coupling voltage calculator is configured to calculate the line coupling voltage based on the plurality of grayscale data voltages respectively corresponding to the grayscale data stored in the frame memory.

7. The data voltage compensator of claim 1, wherein the first data converter includes the first LUT configured to store the plurality of grayscale data voltages corresponding to the grayscale data.

8. The data voltage compensator of claim 1, wherein the second data converter includes the second LUT configured to store the compensating grayscale data corresponding to the plurality of compensating data voltages.

9. The data voltage compensator of claim 1, wherein the plurality of grayscale data are digital, and wherein the plurality of grayscale data voltages are analog.

10. A display device comprising:

a display panel including a plurality of data lines, a plurality of scan lines, and a plurality of pixels formed in intersection regions of the data lines and the scan lines;

a data voltage compensator configured to i) convert a plurality of grayscale data that are digital signals respectively to a plurality of grayscale data voltages that are analog signals based on a first look-up table (LUT) including a relationship between the grayscale data and the plurality of grayscale data voltages, ii) compensate, with a plurality of compensating grayscale data voltages, a line coupling voltage which is defined as a voltage on a parasitic capacitor formed between each of the data lines and the corresponding pixel, wherein the data voltage compensator is configured to calculate the line coupling voltage based on the difference between first grayscale data provided to a first pixel of the pixels in an (N−1)th row and second grayscale data provided to a second pixel of the pixels in an Nth row, where the N is an integer equal to or greater than 2, and iii) convert the plurality of compensating grayscale data voltages to a plurality of compensating grayscale data based on a second LUT including a relationship between the plurality of compensating data voltage and the compensating grayscale data;

a data driver configured to convert the compensating grayscale data to a data signal and provide the data signal to all the pixels via the data lines;

a scan driver configured to provide a scan signal to all the pixels via the scan lines; and a timing controller configured to control the data voltage compensator, the data driver, and the scan driver.

11. The display device of claim 10, wherein the data voltage compensator includes:

a memory configured to receive the grayscale data and store the grayscale data;

a first data converter configured to i) convert the grayscale data respectively to a plurality of grayscale data voltages including first and second grayscale data voltages respectively corresponding to the first and second grayscale data based on the first LUT;

a coupling voltage calculator configured to receive the plurality of grayscale data voltages and calculate the line coupling voltage based on a difference between the first grayscale data voltage and the second grayscale data voltage;

a compensating data generator configured to generate a plurality of compensating data voltages corresponding to the compensating grayscale data, which include a sum of the line coupling voltage and the corresponding one of the plurality of grayscale data voltages, so as to compensate the line coupling voltage; and a second data converter configured to convert the plurality of compensating data voltages respectively to a plurality of compensating grayscale data based on the second LUT and output the compensating grayscale data to the data driver.

12. The display device of claim 10, wherein the coupling voltage calculator is configured to multiply a predetermined coupling ratio by a difference between the first and second grayscale data voltages, calculate an amount of coupling for each pixel based on the result, and output a mean value of the amounts of the coupling for the plurality of pixels as the line coupling voltage of the data line, and wherein the predetermined coupling ratio includes a ratio of i) the difference between the grayscale data voltage corresponding to the grayscale data provided to the first pixel and the grayscale data voltage corresponding to the grayscale data provided to the second pixel to ii) an amount of the coupling that occurs on the first pixel.

13. The display device of claim 10, wherein the memory includes a line memory configured to store the grayscale data to be provided to the pixels of at least two rows.

14. The display device of claim 13, wherein the coupling voltage calculator is configured to calculate the line coupling voltage based on the plurality of grayscale data voltages respectively corresponding to the grayscale data stored in the line memory, and wherein the compensating data generator is configured to add the line coupling voltage to the plurality of grayscale data voltages respectively corresponding to the grayscale data and output the added value as the plurality of compensating data voltages of a next frame.

15. The display device of claim 10, wherein the memory includes a frame memory configured to store the grayscale data to be provided to all the pixels per frame of the display panel.

16. The display device of claim 15, wherein the coupling voltage calculator is configured to calculate the line coupling voltage based on the plurality of grayscale data voltages respectively corresponding to the grayscale data stored in the frame memory, and wherein the compensating data generator is configured to add the line coupling voltage to the plurality of grayscale date voltages corresponding to the grayscale data stored in the frame memory and output the added value as the plurality of compensating data voltages.

17. The display device of claim 10, wherein the first data converter includes a look-up table (LUT) configured to store the grayscale data voltage corresponding to the grayscale data.

18. The display device of claim 10, wherein the second data converter includes a look-up table (LUT) configured to store the compensating grayscale data corresponding to the compensating data voltage.

19. The display device of claim 10, wherein the timing controller includes the data voltage compensator.

20. The display device of claim 10, wherein the data voltage compensator is electrically connected to the timing controller.

21. A display device comprising:

a display panel including a plurality of data lines, a plurality of scan lines, and a plurality of pixels formed in intersection regions of the data lines and the scan lines;

a data voltage compensator configured to calculate a line coupling voltage for each of the data lines corresponding to an amount of coupling generated via a parasitic capacitor formed between each pixel and the corresponding data line, wherein the data voltage compensator includes:

a first data converter configured to i) receive a plurality of grayscale data corresponding to each pixel, ii) convert the grayscale data respectively into a plurality of grayscale data voltages based on a first look-up table (LUT) including a relationship between the grayscale data and the plurality of grayscale data voltages and ii) output the plurality of grayscale data voltages and iii) output the plurality of grayscale data voltages;

a coupling voltage calculator configured to receive the plurality of grayscale data voltages and calculate the line coupling voltage based on the plurality of grayscale data voltages;

a compensation data generator configured to i) receive the line coupling voltage from the coupling voltage calculator and the plurality of grayscale data voltages from the first data converter, and add the line coupling voltage to the plurality of grayscale data voltages so as to generate a plurality of compensating data voltages; and a second data converter configured to i) receive the plurality of compensating data voltages, ii) convert the plurality of compensating data voltages to a plurality of compensating grayscale data based on a second LUT including a relationship between the plurality of compensating data voltage and the compensating grayscale data and iii) output the plurality of compensating grayscale data;

a data driver configured to convert the plurality of compensating grayscale data to a plurality of data signals and provide the data signals to the pixels via the data lines;

a scan driver configured to provide a scan signal to the pixels via the scan lines; and a timing controller configured to control the data voltage compensator, the data driver, and the scan driver.

* * * * *